US010933277B2

(12) United States Patent
Calvaruso

(10) Patent No.: US 10,933,277 B2
(45) Date of Patent: Mar. 2, 2021

(54) EXERCISE MAT

(71) Applicant: Holistic Wellness Limited, Wanchai (HK)

(72) Inventor: Dario Calvaruso, Wanchai (HK)

(73) Assignee: Holistic Wellness Limited, Hong Kong (HK)

( * ) Notice: Subject to any disclaimer, the term of this patent is extended or adjusted under 35 U.S.C. 154(b) by 96 days.

(21) Appl. No.: 15/778,413

(22) PCT Filed: May 26, 2017

(86) PCT No.: PCT/IB2017/053102
§ 371 (c)(1),
(2) Date: May 23, 2018

(87) PCT Pub. No.: WO2017/208120
PCT Pub. Date: Dec. 7, 2017

(65) Prior Publication Data

US 2018/0353800 A1 Dec. 13, 2018

(30) Foreign Application Priority Data

May 30, 2016 (HK) ..... 16106117.7

(51) Int. Cl.
*A63B 21/00* (2006.01)
*A63B 71/06* (2006.01)

(52) U.S. Cl.
CPC ..... *A63B 21/4037* (2015.10); *A63B 71/0622* (2013.01); *A63B 2071/0625* (2013.01); *A63B 2071/0694* (2013.01); *A63B 2208/02* (2013.01); *A63B 2220/20* (2013.01)

(58) Field of Classification Search
CPC ..... A63B 21/4037; A63B 71/0622; A63B 2071/0625; A63B 2208/02; A63B 2220/20; A63B 2071/0694
See application file for complete search history.

(56) References Cited

U.S. PATENT DOCUMENTS

D457,373 S * 5/2002 Prinzmetal ..... D6/582
6,387,013 B1 * 5/2002 Marquez ..... A63B 6/00 473/278
7,465,263 B1 * 12/2008 Conrad ..... 434/393
(Continued)

FOREIGN PATENT DOCUMENTS

CN 102438705 A 5/2012
WO 0152953 A1 7/2001

OTHER PUBLICATIONS

Wan, Jixiang, Authorized Officer, State Intellectual Property Office of the P.R. China, "International Search Report" in connection with related International Application No. PCT/IB2017/053102, dated Sep. 7, 2017, 2 pgs.

*Primary Examiner* — Andrew S Lo
(74) *Attorney, Agent, or Firm* — Kolisch Hartwell, P.C.

(57) ABSTRACT

An elongate mat has a surface upon which are located a plurality of indicia for guiding placement of one or more parts of a user's body when performing a plurality of yoga postures thereon. The anatomical measurements of the parts of the user's body determine the location of the plurality of indicia on the mat. There is also provided a method of performing exercises upon the mat, a method of forming a plurality of indicia on or in the mat, and a computerized system for manufacture of a mat.

11 Claims, 9 Drawing Sheets

(56) References Cited

U.S. PATENT DOCUMENTS

D584,093 S * 1/2009 Drumm ..... A63B 21/4037 D21/662
8,317,660 B2 11/2012 Goranson
8,499,383 B1 * 8/2013 Ungaro ..... A63B 23/03516 D21/686
D733,461 S * 7/2015 Diaz ..... D6/592
9,241,589 B2 1/2016 Saltzman
10,315,065 B1 * 6/2019 Soba ..... A63B 21/4035
10,500,438 B1 * 12/2019 Lemire ..... A63B 26/003
D878,497 S * 3/2020 Miles ..... D21/686
2001/0034288 A1 10/2001 Howlett-Campanella
2002/0142888 A1 * 10/2002 Marques ..... A63B 6/00 482/23
2003/0017915 A1 * 1/2003 Prinzmetal ..... A63B 6/00 482/23
2004/0214692 A1 * 10/2004 Koenig ..... A63B 21/4037 482/23
2007/0088232 A1 * 4/2007 Corradini ..... A61H 37/00 601/28
2009/0062076 A1 * 3/2009 Curley ..... A63B 26/00 482/23
2009/0239724 A1 * 9/2009 White ..... A63B 23/0244 482/142
2010/0048356 A1 * 2/2010 Hamilton ..... A63B 23/0244 482/4
2010/0240508 A1 * 9/2010 Guarrasi ..... G09F 7/00 482/142
2011/0072581 A1 * 3/2011 Villa ..... A63B 21/4037 5/420
2011/0111926 A1 5/2011 Goranson
2011/0131723 A1 * 6/2011 Andrews ..... A45F 3/14 5/417
2012/0015334 A1 * 1/2012 Hamilton ..... A63B 71/0622 434/247
2012/0233772 A1 * 9/2012 Wang ..... A47G 27/0237 5/417
2013/0180048 A1 * 7/2013 Saltzman ..... A63B 23/035 5/417
2014/0007345 A1 1/2014 Hasta
2014/0237718 A1 * 8/2014 Burch ..... A63B 21/4037 5/417
2015/0328495 A1 11/2015 Soba
2015/0364059 A1 * 12/2015 Marks ..... G16H 20/30 482/9
2016/0016028 A1 * 1/2016 Thompson ..... A63B 21/4037 5/417
2016/0045779 A1 * 2/2016 Hasta ..... A47G 9/062 5/417
2016/0136476 A1 5/2016 Saltzman
2016/0279462 A1 * 9/2016 Sutherland ..... A63B 21/4035
2017/0128816 A1 * 5/2017 DeMarch ..... A63B 71/0622
2017/0340946 A1 * 11/2017 Simon ..... A63B 21/4037

* cited by examiner

The triangle sequence

5 parts of 30 breaths = 150 breaths = 16 minutes (at 75 BPM)

from neutral to recovery

[standing flat pose 3] I - - III - - V - [downward facing dog 3].

...

from recovery to side-stretch

{I - - III - - V - [extended triangle pose 6];

from side-stretch to recovery

I - - III - - V - [downward facing dog 3]}RL.

3K+6S=9 + 3K+3S=6 = 15xRL = 30BR from recovery to twisted-stretch

{I - - III - - V - [reversed triangle pose 6];

from twisted-stretch to recovery

I - - III - - V - [downward facing dog 3]}RL.

3K+6S=9 + 3K+3S=6 = 15xRL = 30 breaths from recovery to strengthening level 1 and level 2

{I - - III - [side warrior pose 3] - V - [frontal warrior pose3];

from strengthening to balancing level 1

I - - III - - V - [fastened one-leg balancing pose 3];

from balancing level 1 to balancing level 2 and 3

I - [fastened extended half-moon pose 3] - III - - V - [fastened twisted half-moon pose 3];

from balancing to recovery

I - - III - - V - [downward facing dog 3]}RL.

2K+3S+1K+3S=9 3K+3S=6 1K+3S+2k+3S=9 3K+3S=6 = 30 breaths x RL = with sides = 60 breaths from recovery to inversion level 1 and 2

I - - III - - V - [forearm-supported head-pose / peacock pose 6];

from inversion to strengthening to recovery

I - - III - [bird pose 3] - V - [downward facing dog 3];

from recovery to posterior stretch, from posterior stretch to anterior-stretch, from anterior-stretch to neutral position I - [posterior-stretch pose 6] - III - [anterior-stretch pose 3] - V - [standing flat pose].

3K+6S=9 2K+3S+1K+3S=9 1K+6S+1K+3S+1K=12 = 30 breaths

FIG. 4

EXERCISE MAT

FIELD OF THE INVENTION

The present invention relates to an improved exercise mat and a method of manufacturing and using the improved exercise mat.

BACKGROUND OF THE INVENTION

Scientific studies emphasise the importance of exercise for overall wellbeing of persons in today's busy modern world. The increased awareness of the importance of exercise, particularly for sedentary office workers has led to a rediscovery in many parts of the world of ancient forms of exercise, with increased popularity in many different types including mat based yoga and tai chi.

However, as with other forms of exercise, these exercises can be performed incorrectly by unskilled participants, which can limit the benefits of the exercise and can also lead to increased risk of injury.

Beginners in mat based exercises typically attend instructed classes, either in private sessions or in group-based sessions to learn the correct posture and stances, and the sequence of stances to be adopted.

Where individuals practice by themselves without an instructor present it is particularly difficult for beginners to orient themselves in an appropriate posture with the correct stance and arrangement of their body.

Particularly in the group-based sessions it is difficult for a single instructor with multiple students to adequately supervise all students, as their role includes demonstrating the stances or poses, ensuring that students correctly position themselves when performing the exercises and maintaining interest and enthusiasm for all participants. Multiple instructors and/or a mixture of videos and recorded instructions may increase the level of supervision available however such arrangements are still constrained.

Various prior art exercise mats exist which include various forms of printed marks which attempt to assist practitioners of mat based exercises to stand/sit on the mat and align themselves in various postures and in accordance with recorded instructions on video and/or audio, or under personal instruction.

However, the indicia or markings on these prior art mats tends to be complex, overly detailed and not applicable to beginners which can lead to incorrect stances, positions and detracts overall from the benefits such exercise can provide.

Accordingly it is an object of this invention to provide an improved exercise mat which addresses or at least ameliorates some of the deficiencies and problems associated with prior art exercise mats.

SUMMARY OF THE INVENTION

In an aspect of the present invention there is provided an elongate mat having a surface, the mat comprising: a plurality of indicia located about the surface for guiding placement of one or more parts of a user's body when performing a plurality of yoga postures thereon, wherein the anatomical measurements of the parts of the user's body determine the location of the plurality of indicia on the mat.

Advantageously, the plurality of indicia may be located symmetrically about a longitudinal axis.

Optionally, the plurality of indicia may include at least three transverse lines, three marks extending substantially parallel to the longitudinal axis, at least one marking on the central longitudinal axis, and two markings on each side and spaced apart from the central longitudinal axis.

The anatomical dimensions of the user specified may include the group of measurements comprising: the distance from the collarbone of the user to the floor, the foot length of the user from the base of the heel to the base of the toe, the tip of the middle finger of the user to the base of the palm, the base of the middle finger of the user to the base of the palm, the width across the shoulders of the user, the distance from the elbow of the user to the tip of the little finger, the full length of the foot of the user and the length of the tibia of the user.

Preferably a first transverse line is made at a predetermined distance from the distal end of the mat. Optionally, a second transverse line may be spaced apart from the first transverse line at a distance corresponding to the distance from the collarbone of the standing user to the floor less the distance from the tip of the middle finger of the user to the base of the palm.

A third transverse line may be spaced apart from the second transverse line by a distance corresponding to the distance from the base of the middle finger of the user of the mat to the base of the palm and spaced apart from the second transverse line and further distal to the first transverse line.

A first pair of vertical marks may extend from the second transverse line, each of said first pair of marks on either side from the central longitudinal axis and being spaced apart from the central longitudinal axis of the mat at a distance corresponding to the length of the foot of the user from the heel to the toe of user, each of the first pair of marks extending in a direction of parallel to the longitudinal axis.

Preferably a second pair of vertical marks extend in the direction of the first transverse line at a location spaced apart from the first transverse line a distance corresponding to the distance from the collarbone of the standing user to the floor; said second pair of vertical marks spaced apart on either side of the longitudinal axis, each of said second pair of vertical marks being spaced apart from the longitudinal axis by a distance corresponding to half of the distance between the shoulders of the user.

Optionally a first cross indicia may be made on the longitudinal axis by measuring a distance from a first pair of origins located on either side of the longitudinal axis on the second transverse line at a distance of half the shoulder width of the user from the longitudinal axis, the distance corresponding to distance from the elbow of the user to the tip of the little finger of the user.

Preferably a pair of second cross indicia are located on the mat, by measuring a distance from a second origin located on the longitudinal axis at a distance from the first transverse line corresponding to the distance from the collarbone of the standing user to the floor, and wherein one of each pair of second cross indicia is located on either side of the longitudinal axis at a distance corresponding to the distance from the elbow of the user to the tip of the little finger of the user.

Preferably a pair of third cross indicia are located on the mat, each of said pair being located at a distance from the first transverse line which is the sum of the full length of the foot of the user, the length of the tibia of the user and the length of the heel of the user to the base of the big toe; and wherein each of the pair of the third cross indicia are spaced apart from the longitudinal axis by a transverse distance corresponding to the length of the foot of the user from the heel to the toe of user on either side of the longitudinal axis.

In a further aspect of the invention there is provided a method of performing yoga on a mat having a surface with indicia thereon, wherein the locations of the indicia on the mat are determined according to the anatomical dimensions of the user.

Preferably the indicia are located on the mat as described above.

In still another aspect of the invention there is provided a method of forming a plurality of indicia on or in a mat wherein the anatomical dimensions of the user of mat determine the location of the plurality of indicia.

Preferably, the indicia are formed on or in the mat by marking, printing, chemical etching, mechanical ablation, deposition or applying ink to a stencil providing the location of the indicia.

In a further aspect, there is provided a computerised system for producing a mat having a plurality of indicia located about the surface of the mat for guiding placement of one or more parts of a user's body when performing a plurality of postures thereon, the system comprising a software program configured for execution on a processor to receive user specified anatomical measurements of parts of the user's body a server having a processor and a communications interface, the server configured to receive via the communication interface user specified anatomical measurements of parts of the user's body and execute on the processor one or more predetermined processes to determine the location of the plurality of indicia on the mat, and provide instructions to a formation means configured for forming indicia on the mat.

Preferably the formation means is configured to prepare a stencil for application to the surface of the mat, the stencil having a plurality of apertures located about the mat guiding location of the indicia thereon.

BRIEF DESCRIPTION OF THE DRAWINGS

Preferred embodiments of the present invention will be explained in further detail below by way of examples and with reference to the accompanying drawings, in which:

FIG. 4 shows an exemplary routine in which a series of poses which are held for the breaths indicated, using a mat with indicia according to the anatomical dimensions of each user.

DETAILED DESCRIPTION OF THE PREFERRED EMBODIMENTS

In one embodiment of the present invention, the exercise mat may be used for performing the exercise program and physical therapy routine that is known as yoga. There are many different styles, elements and approaches to yoga, which brings together aspects of breath, vital energy and engagement of vital centres, as well as physical bodily movement, mental attitude and presence as well as breath control aspects.

For some yoga can be involve a series of individual poses in which instructors suggest a series of poses according to the skill and fitness level of the students in a relatively ad hoc/unstructured process considering the individual's competencies, strengths and the instructor's preferences for particular stances/poses.

For others, the practice of yoga may involve a systemised repeatable series of postures, performed with rhythmic precision to coordinate with the individual's breaths and selected and combined together to exercise all muscles in the body.

Whether the more unstructured style of yoga or a highly structured variant thereof, or any other arrangement in between, yoga exercises can be performed using the improved personalised exercise mat of the present invention.

Advantageously, the mat of the present invention, being customised according to anatomical dimensions of each individual enhances the ability of that individual to adopt the correct positioning and alignment of their various extremities on the mat in each of the poses performed during the yoga session. Having "landmarks" by which the user is able to orient themselves assist users with underdeveloped proprioception to adopt the correct postures, facilitating self-correction and also instruction by an instructor. The indicia on the mat can also enhance the ability of an individual to correctly perform a pose or position as directed by audio or video which may be downloaded, or alternatively even streamed across the internet.

In a broad aspect of the present invention there is provided details of the process for determining where to locate indicia on an improved exercise mat, together with an illustration of how the improved exercise mat may be used. It would be appreciated that various other embodiments of the positions/poses depicted, as well as the styles used for the markings could be made without departing from the scope of the present invention. Furthermore, it would be appreciated that although the present invention describes a number of ways in which the indicia may be formed on the mat at the identified locations, the present invention is not limited to these forms.

Figure 1A:
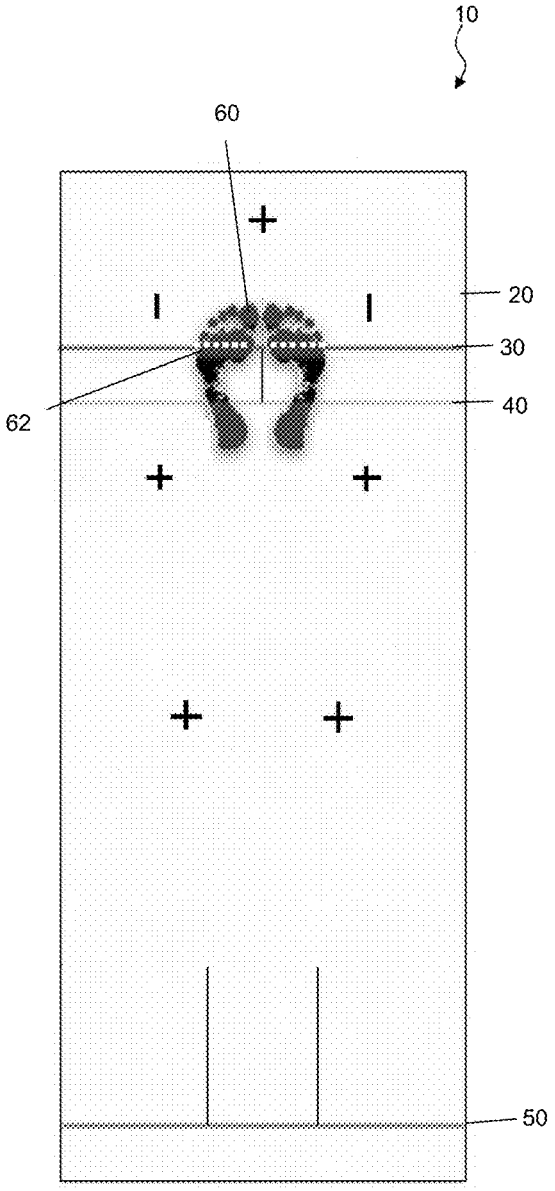
FIG. 1*a* shows an embodiment of an exercise mat of the present invention in which the location of the extremities of the user in a first position/pose (samasithi-standing upright pose) are shown.
Figure 1B:
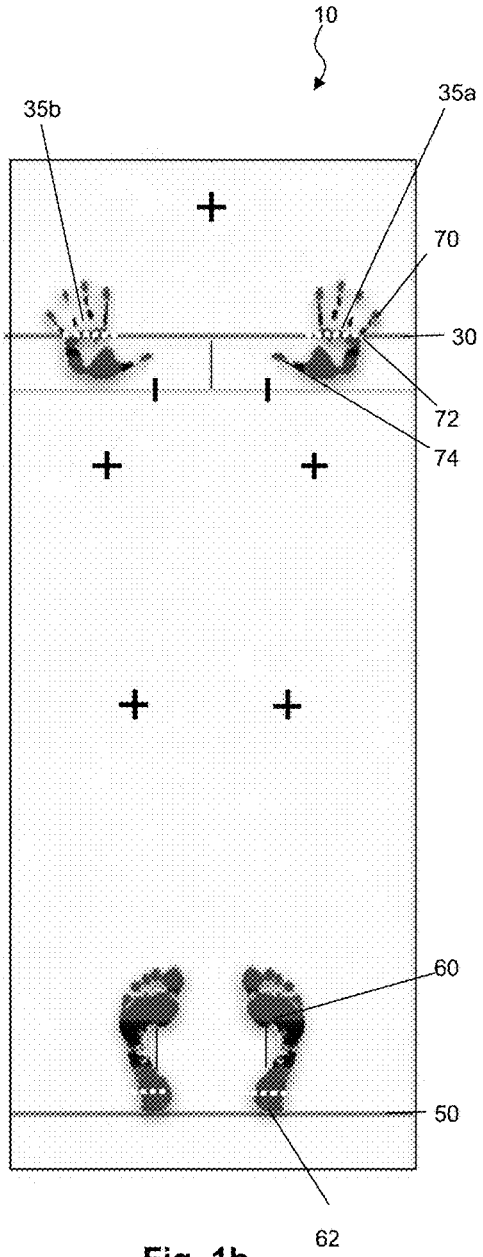
FIG. 1*b* shows an embodiment of an exercise mat of the present invention in which the location of the extremities of a user in a second position/pose (adomukha svanasana—downward facing dog) is shown.
Figure 1C:
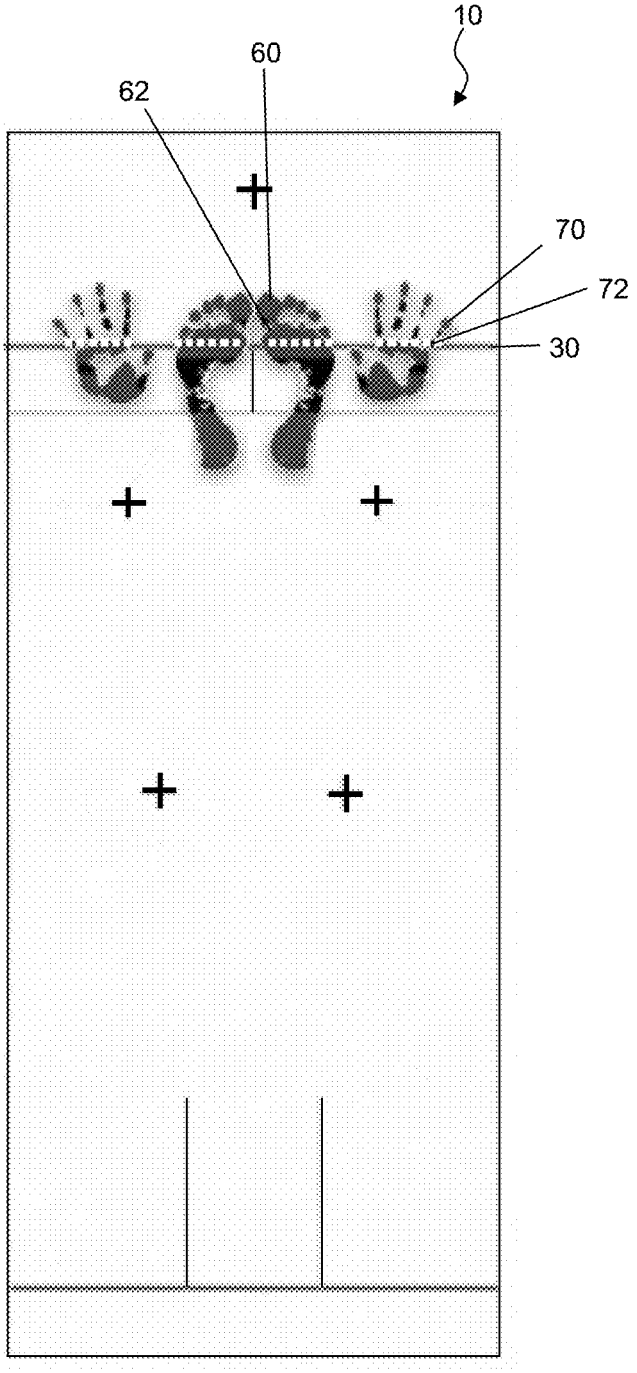
FIG. 1*c* shows an embodiment of an exercise mat of the present invention in which the location of the extremities of a user in a third position/pose (utthanasana or upward-facing stretching pose) is shown.

Referring to FIGS. 1*a*-1*c* there is shown an embodiment of improved exercise mat 10 according to the present invention in which the location of user's bodily extremities in various positions/poses are displayed.

In the arrangement shown, the pose of FIG. 1 a is the well-known Standing Upright Pose (samasthiti) which is the initial position for the series of movements which are to be performed on the mat.

As shown, to orient the user at the correct location in the mat, the user's two feet 60 are placed together, on either side of the longitudinal axis of the mat, so that the mid portions 62 of the foot 60 are on the First Horizontal ("1H") transverse line (denoted by reference numeral 30) of the mat. The user may engage in breathing and focus on their posture, secure in the knowledge that they are at the correct location for subsequent movements relative to the mat.

Next, as shown in FIG. 1*b*, the user may move to a pose known as adhomukha svanasana or "Downward Facing Dog". In this pose, the hands 70 of the user are located so that the mid portions 72 of the hands are on the First Horizontal ("1H") transverse line 30 of the mat with the thumbs 74 above the 2v indicia 35*a,b* of the mat. The feet 62 of the user are located on the 3H horizontal transverse line, centred about the imaginary line extending from the thumbs 74 (hence the 2v indicia 35*a,b* of the mat). In this position, with the hands and feet positioned as shown essentially the user is bent in half, an excellent position to stretch tight hamstrings and backs.

It would be appreciated that in the transition from the Standing Upright Pose shown in FIG. 1*a* to the "Downward Facing Dog" of FIG. 1*b* can be assisted by knowing exactly where a user needs to place the feet and palms relative to the mat using the indicia located on the mat.

As each mat is tailored to the individual anatomical dimensions of the user using the mat, the locating indicia assist the user to locate themselves in the correct posture for the position being held, and it is relatively easier for an instructor to issue directions to the student(s) in a class—for example emphasising the relevant indicia the appropriate part of the body should be placed.

Referring next to FIG. 1*c*, there is depicted an exemplary arrangement of the parts of the user's body in a pose known as urdhvambukha utthanasana or "Upward Facing Stretching Pose".

In this position the feet 60 and hands 70 are placed so that the mid portion 62 of the hands and mid portion 72 of the feet are located on either side of the longitudinal axis of the mat, and centred about the First Horizontal ("1H") transverse line 30. In this pose the user is oriented correctly on the mat for a flowing transition from the previous pose depicted in FIG. 1*b*, with the user location assisted by the use of the indicia on locations on the mat which are determined by the anatomical dimensions of that user's body.

It would be appreciated that the poses depicted in FIG. 1*a*-1*c* are exemplary only, and for the purposes of illustrating how the user orientates their body relative to the indicia of the mat. A variety of other poses and positions would be possible, relative to the indicia located about the mat, the location of which is discussed below.

Referring now to FIGS. 2*a*-2*h* there is depicted a mat 10 according to an embodiment of the present invention.

Figure 2A:
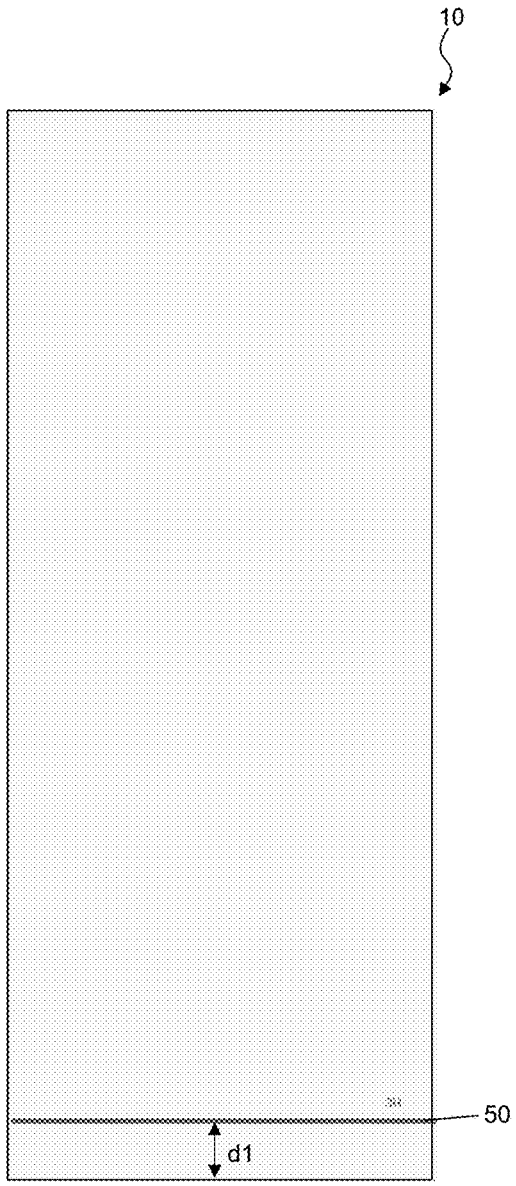
FIG. 2*a* shows a front view of an embodiment of the exercise mat of the present invention in an initial stage in forming indicia on the mat.

Referring to FIG. 2*a*, as shown, at the distal end of the mat, at a distance D1 (approximately 15 centimetres away from the end of the mat), a line is made transverse to the mat being the Third Horizontal ("3H") denoted by reference numeral 50. This line is a starting line and serves as a line which defines the extremity of postures which are performed on the mat. As shown at the distance marked M1, a dotted transverse line marked Zero Horizontal ("0H") 20 is depicted at the proximal end of the mat.

Distance M1 corresponds to the anatomical measurement of the user of the mat's collarbone to the floor. The measurement of this distance M1 may be measured by a third party, in order to ensure that this measurement is accurate.

Then, at a distance M3 a second line denoted as Second Horizontal ("2H") transverse line is formed (denoted by reference numeral 40). This distance M3 corresponds to the distance from the tip of the middle finger to the bottom or base of the palm of the user of the mat.

Finally, after the Second Horizontal ("2H") transverse line (40) is marked, a final line First Horizontal ("1H") transverse to the mat is marked by reference numeral 30. The 1H line 30 is at a distance corresponding to M4, the distance from the base of the middle finger to the bottom of the user's palm.

Figure 2B:
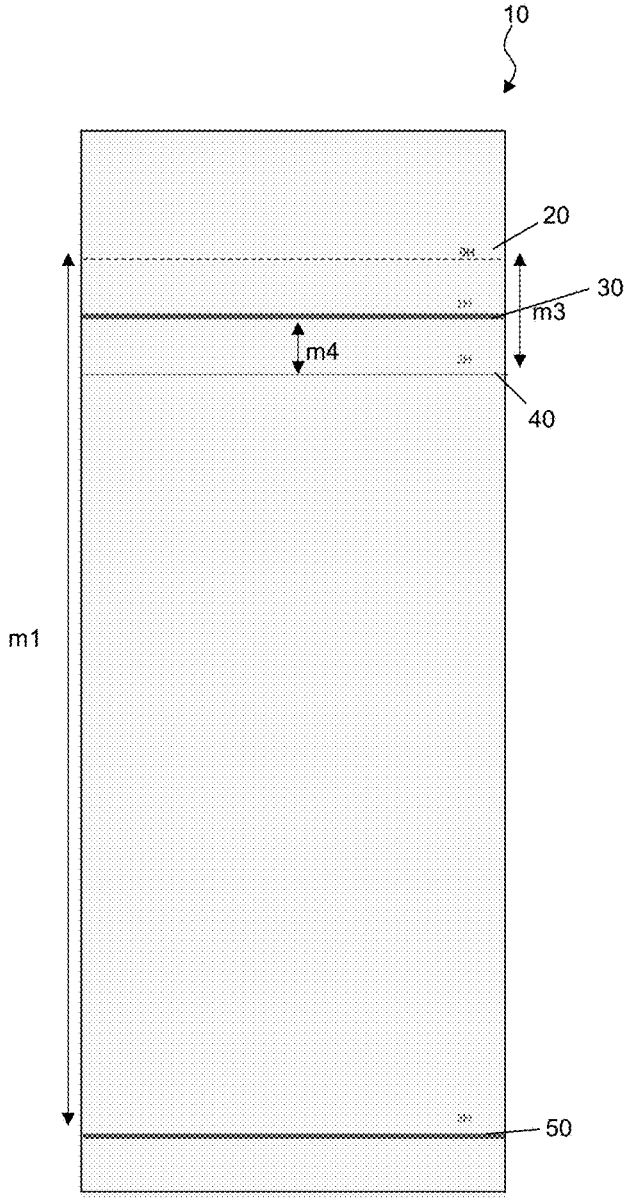
FIG. 2*b* shows the embodiment of the exercise mat of FIG. 2*a* for a user in a subsequent stage of forming indicia on the mat.

Accordingly, the horizontal or transverse lines of the mat have been formed according to measurements of the user, and as described in relation to FIGS. 2*a*, 2*b*.

Figure 2C:
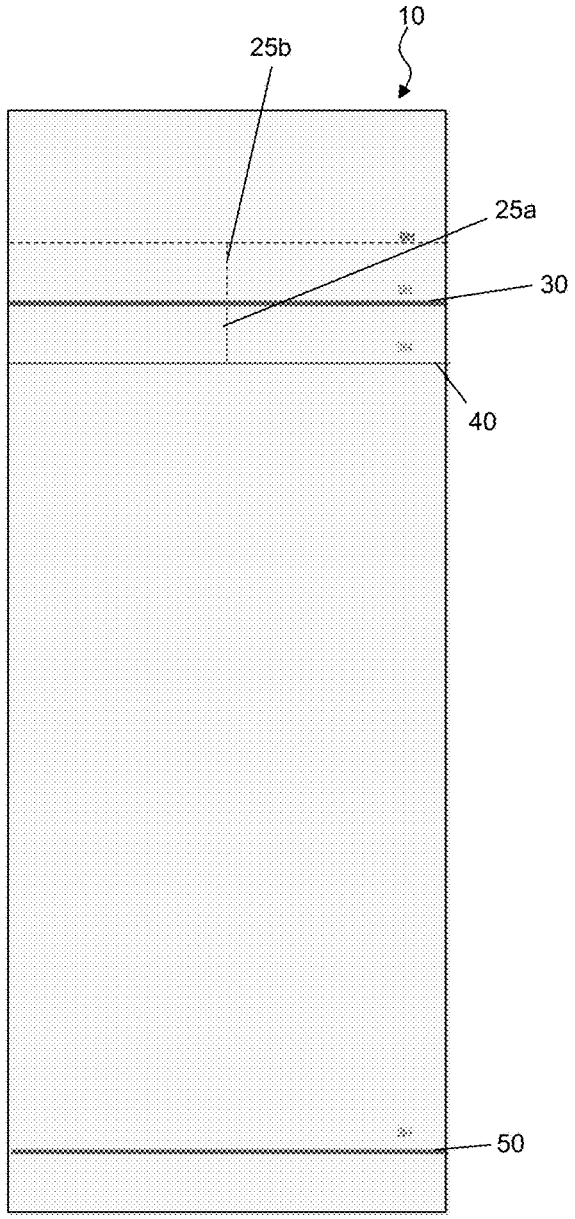
FIG. 2*c* shows the embodiment of the exercise mat of FIG. 2*a* for a user in a further stage of forming indicia on the mat.

Referring now to FIG. 2*c*, the vertical line—First Vertical ("1V") 25*a*—is formed between the as Second Horizontal ("2H") transverse line (40) and the First Horizontal line (1H) 30. A dotted line outline may be included in 25*b* extending to the 0H line. Preferably, the 1V vertical line is made at the middle of the mat superimposed upon the longitudinal vertical axis of the mat.

Figure 2D:
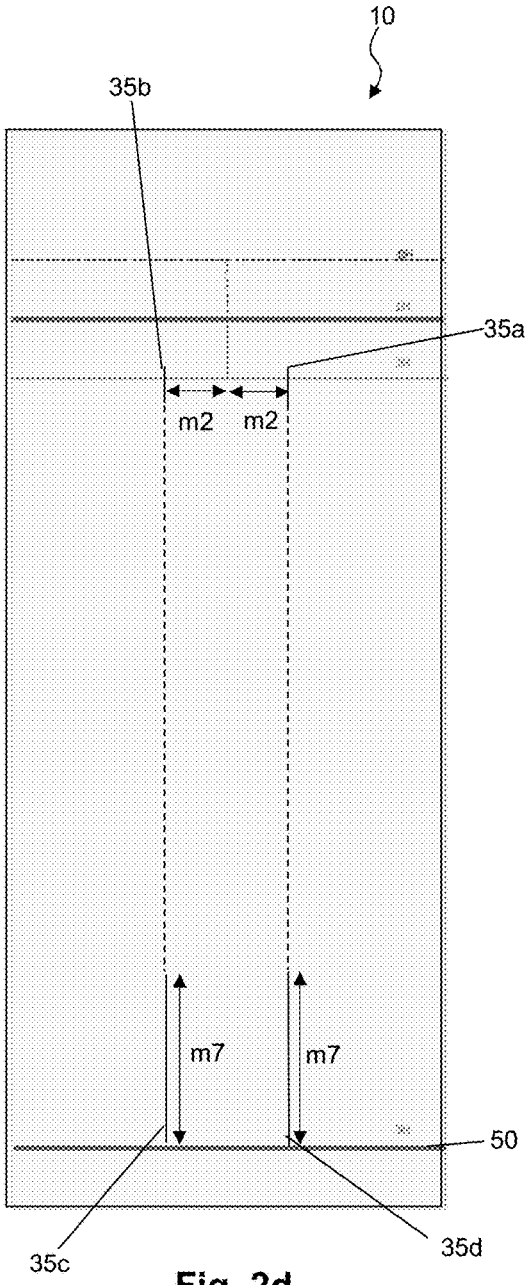
FIG. 2*d* shows the embodiment of the exercise mat of FIG. 2*a* in a further stage of forming indicia on the mat.

Referring now to FIG. 2*d*, additional vertical lines Second Vertical Line ("2V") are included as denoted by items 35*a*, 35*b* at the proximal portion of the mat.

Preferably, these lines should be centred on the as Second Horizontal ("2H") transverse line, and an appropriate size may be approximately 2.5 centimetres in length on either side of the Second Horizontal ("2H") transverse line. However, it would be appreciated that other lengths could be used without departing from the present invention.

Each of the Second Vertical Line ("2V") lines 35*a*, 35*b* are spaced apart from the central longitudinal axis by a distance corresponding to M2, which is a distance of the foot length of the user of the mat, from the end of the heel to the base of the big toe.

As depicted, further vertical lines are located at the distal end of the mat, extending from the third horizontal line 50 in the direction of the proximal end of the mat. Advantageously, the lines 35*c*, 35*d* are the full length of the foot from the top of the big toe to the base of the heel (other lengths of these vertical lines 35*c* and 35*d* could also be used without detracting from the present invention).

Figure 2E:
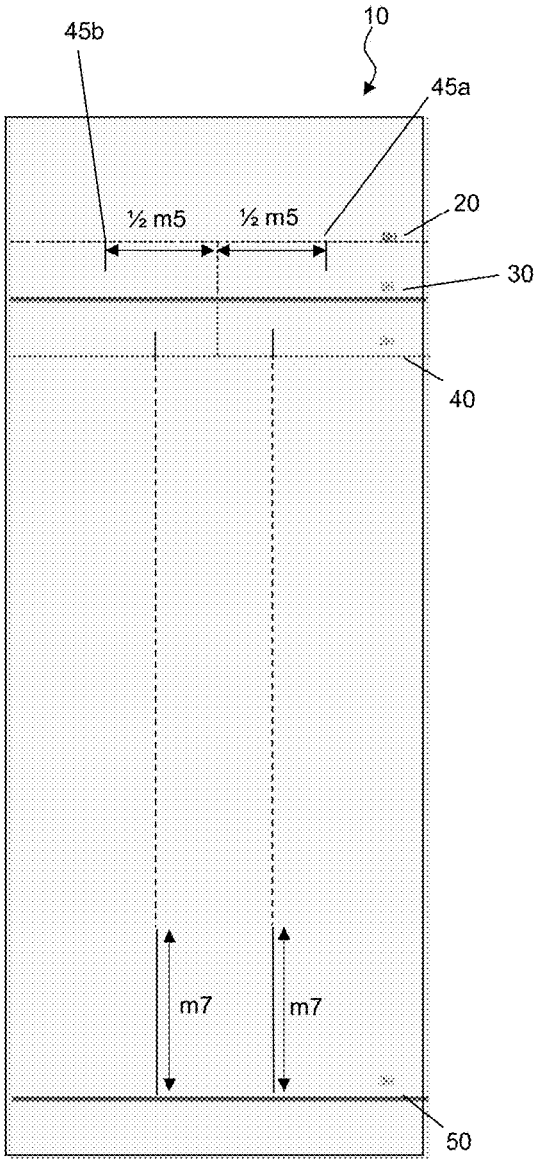
FIG. 2*e* shows the embodiment of the exercise mat of FIG. 2*a* in a further stage of forming indicia on the mat.

Referring now to FIG. 2*e*, it can be seen that the Third Vertical lines 45*a*, 45*b* ("3V") are included. Advantageously, these vertical lines extend from the zero horizontal construction line 20 in the direction of towards the distal end of the mat.

Figure 2F:
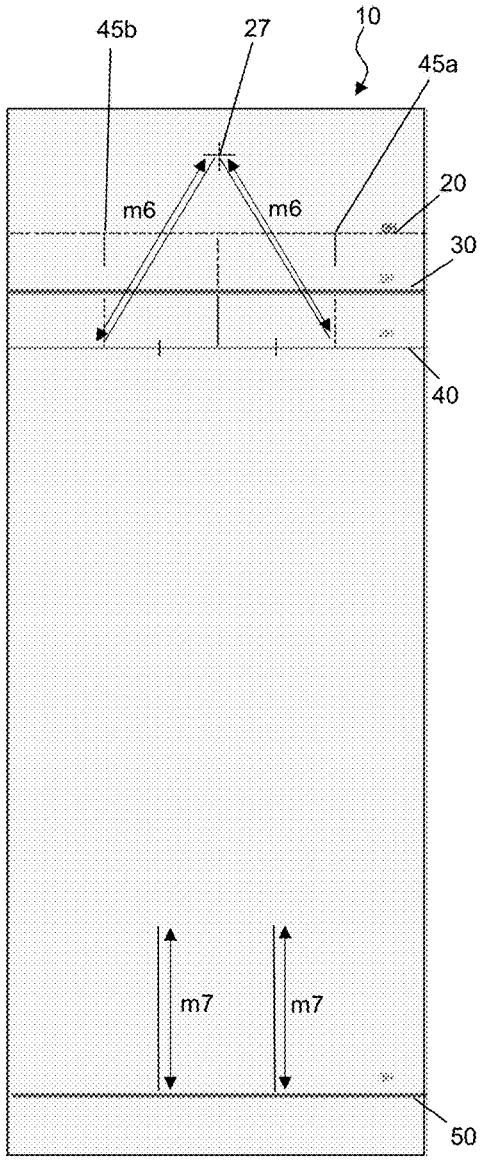
FIG. 2*f* shows the embodiment of the exercise mat of FIG. 2*a* in a further stage of forming indicia on the mat.

As depicted in FIG. 2*e*, the third vertical lines may be spaced apart from the central longitudinal axis at a distance on either side being half the shoulder width of the user of the mat. That is, the full distance between 45*a* vertical line and 45*b* vertical line corresponds to the shoulder width of the user (measured to the outside of the shoulder). Referring now to FIG. 2*f*, there is shown a way of locating an indicia corresponding to the First Cross 27.

Starting from the origin, corresponding to the intersection between a projection of the third vertical lines 45*a*, 45*b* and their intersection with the second horizontal line 40, the distance M6 is measured. (M6 corresponds to the distance from the elbow to the tip of the little finger, and is measured from the origin to an intersection with the central longitudinal axis of the mat).

At this point, based upon this intersection on either or both sides, a cross may be made representing the First Cross "1C" (denoted by reference numeral 27).

Figure 2G:
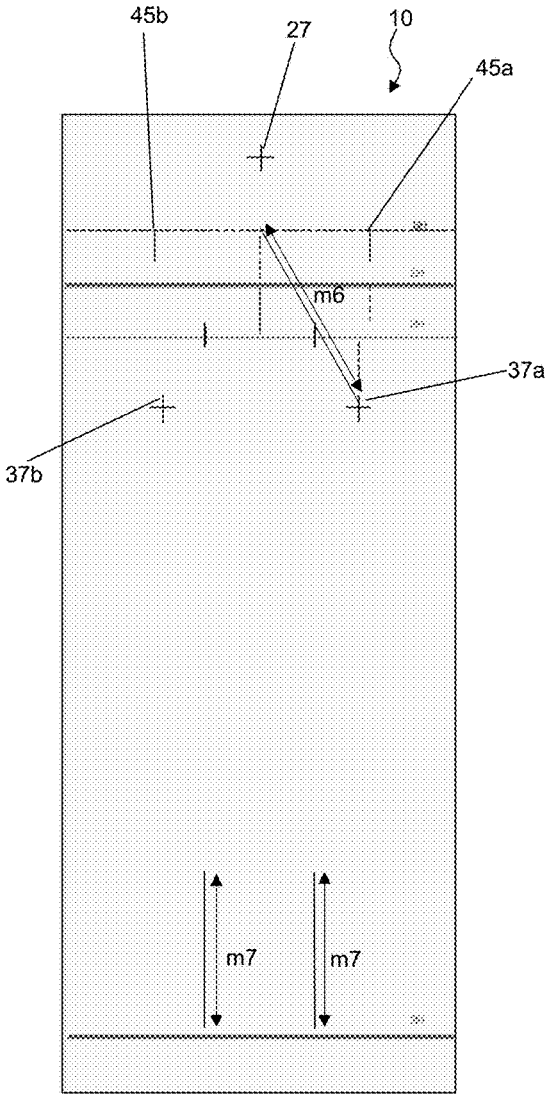
FIG. 2*g* shows the embodiment of the exercise mat of FIG. 2*a* in a further stage of forming indicia on the mat.

A pair of Second Crosses may be formed as shown in FIG. 2*g*. To form these Second Crosses, the distance M6 can be measured from the origin starting at the intersection between the longitudinal axis of the mat and the intersection with the 0H construction line from which the second vertical indicia 45*a*, 45*b* depend.

Starting at this origin, the distance of M6 is projected back to intersect with the vertical line projected down from the 45*a*, 45*b* marking. At this point, on either side of the longitudinal axis, one of the second crosses "2C" denoted by (37*a*, 37*b*) may be made, with one each being marked on either side of the longitudinal axis of the mat. Advantageously, these crosses may be formed such that each side of the crosses extends in a direction of 5 or 10 centimetres depending on the physical size of the user.

Figure 2H:
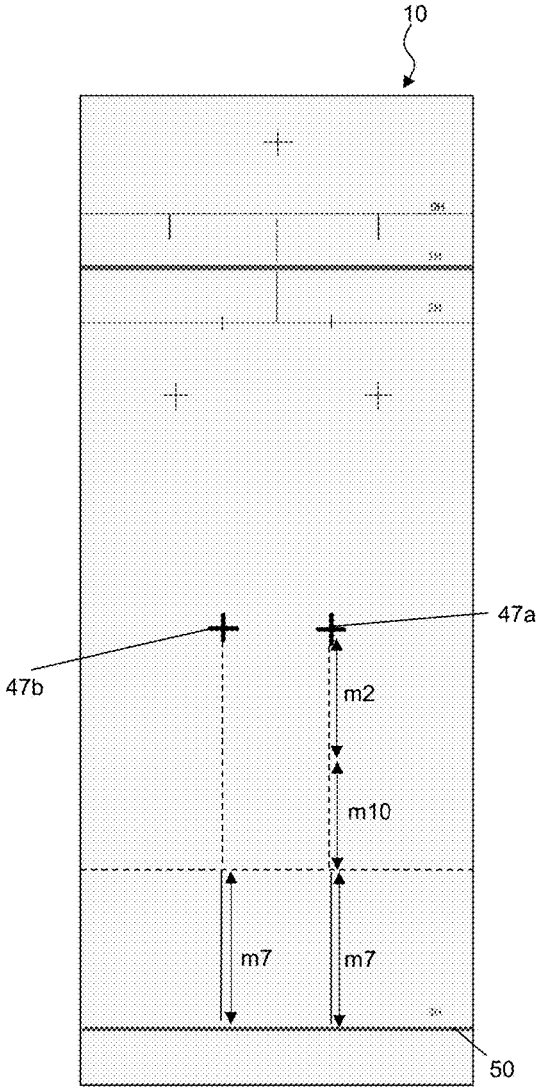
FIG. 2*h* shows the embodiment of the exercise mat of FIG. 2*a* in a further stage of forming indicia on the mat.

Referring to FIG. 2*h*, the third pair of crosses 47*a*, 47*b* can be formed by projecting the second vertical lines up from the distal end of the mat. Advantageously, these crosses can be formed a distance starting from an origin of which is along the 2V lines and spaced apart from the third horizontal line 50 by the full length of the foot (m7).

The third crosses 47*a*, 47*b* can be made at a distance from its origin corresponding to the distance from the knee of the user to the heel contact with the floor (M10) added to the distance corresponding to the foot length of the user—from the heel of a user to the base of the big toe of the user (m2).

These crosses can be made so that the crosses are consistent with the length of the crosses made for the second crosses depicted in FIG. 2*g*.

Figure 3:
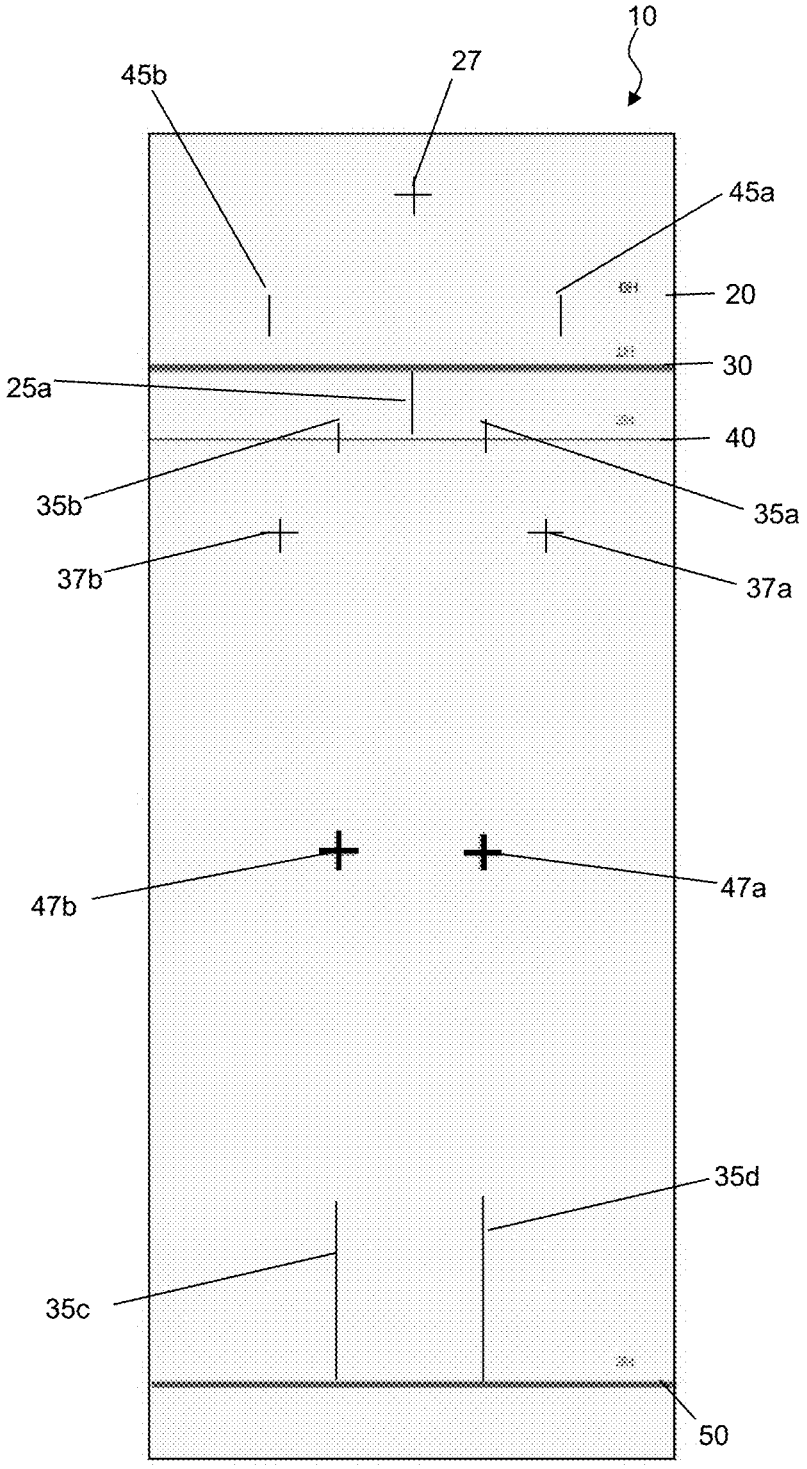
FIG. 3 shows the embodiment of the exercise mat of FIG. 2*a-h* in a finished state.

Referring to FIG. 3 there is depicted a completed version of the mat, with indicia located at location corresponding to various anatomical distances of the user of the mat.

In particular, from the top of the mat to the bottom of the mat, it can be seen that the First Cross 1C 27 is located at the proximal end of the mat followed by the Second Vertical lines 35*a*, 35*b* which extend from the OH (zero horizontal transverse) line 20—this line being omitted as it is not present in the actual embodiment.

Next is the First Horizontal line 1H 30 together with a central vertical portion which extends to the Second Horizontal line 2H (denoted by reference numeral 40). Next the Second Crosses are located, being denoted by 37*a*, 37*b* (2C).

Finally the Third Crosses 47*a*, 47*b* appear, aligned with an extension of the second vertical lines 35*c*, 35*d*. Finally, towards the distal end of the mat there is located the Third Horizontal line (3H) 50.

Although not all of the poses possible in relation to the indicia have been described, it would be appreciated that by locating the indicia about the mat at distances corresponding to the anatomical distances of the user for which the mat has been prepared, a plurality of these poses can be performed with the indicia guiding the user to perform the pose with the correct posture and alignment of the extremities of the body in contact with the mat.

Advantageously, in a further aspect of the present invention, there is depicted an exemplary workout routine in FIG. 4.

In this routine, the indicia on the mat are used to guide the performance of the exercises in a rhythmic fashion. The presence of the indicia together with the co-ordination of the breathing and the postures enables the user to obtain maximum benefit of the yoga routine.

It would be appreciated that the transitions between the various postures, together with the timing of the poses and the co-ordination with the breathing of the user are improved by having the indicia present on the mat, by assisting the user in locating their extremities about the mat for performing the series of poses.

Additionally, when performed with a regular rhythmic device (such as a metronome), the series of poses may be performed as a composite, almost choreographed to the rhythm of a regular beat. The choreography helps co-ordinating the breathing of the user with the postures and the overall transitions and series of poses which form the overall routine. In addition, advantageously, the routine can be performed within a pre-determined timeframe, which will vary of course depending upon the pace of the regular rhythm.

Figure 5:
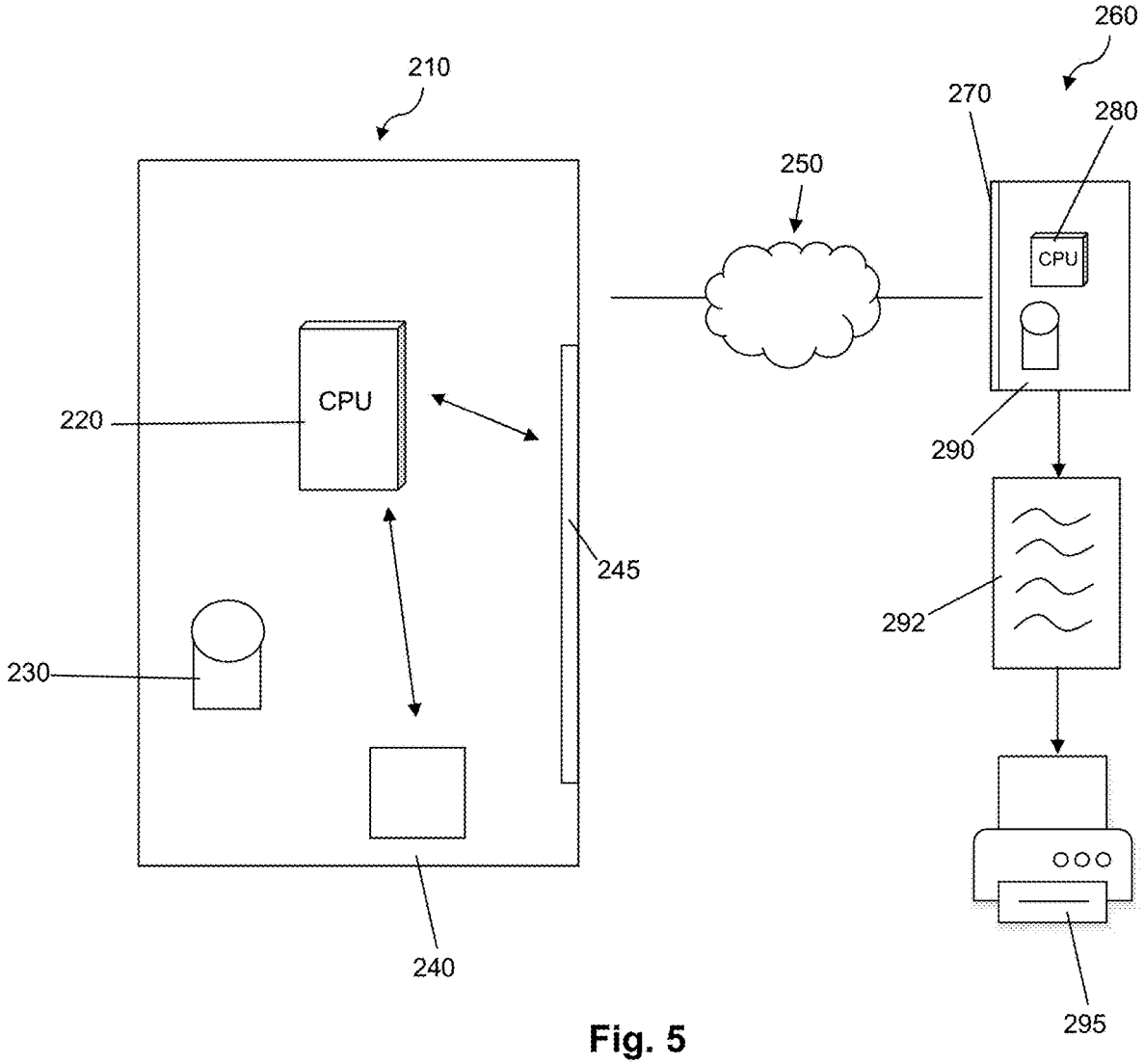
FIG. 5 shows an exemplary schematic system diagram for an embodiment of the present invention wherein the anatomical measurements of the user are transmitted across a network for printing on an exercise mat.

In still yet a further aspect of the present invention, there may be provided a software programme and system configured to receive the various anatomical dimensions of the user. One embodiment is shown in FIG. 5.

This software programme may be executed on the processor 220 of an electronic device such as a tablet computer, mobile phone or desktop computer 210, receiving the various anatomical measurements as set out for derivation of the corresponding location of the indicia about a mat. The measurements may be stored in a data store 230 and displayed on the screen 240 in the software program, or provided as entries in a web page. These measurements may be transmitted across a network, such as the internet 245 to a server 250. On the server there is a processor which receives the measurements across the interface 270 and which may store the measurements in a data store 290.

These measurements may be transmitted to a printer in an appropriate file format 292 for forming the indicia on the yoga mat, preparation of a stencil or other means of forming the indicia at the predetermined locations.

Advantageously, the user may provide their height and mat length in the application, in addition to the other anatomical measurements which are provided. The height and mat length dimensions assist in the correct location of the indicia about the mat. It would be appreciated that the measurements provided by the user could be received on a server from the portable electronic device via a communications interface.

Advantageously, the server or other processor could be configured to determine the appropriate dimensions, and hence output an appropriate control file to regulate the printing so that the indicia are printed on the specified locations about the mat.

The system, method of marking on the mat, and the mat of the embodiments of the present invention depicted above are illustrative only, and other embodiments including various shape and sized indicia may be implemented without detracting from the scope of the present invention.

Different types of exercise may be performed on the mat, and different designs or styles for the indicia may be located about the mat, these indicia being relevant to the exercise or series of exercises being performed, without departing from the present invention.

The embodiment depicted above, is an embodiment corresponding to a Yoga exercise. It would be appreciated that various postures, stances or poses of yoga could be employed which use some or most of the marks for indicia of the mat, without detracting from the present invention.

Overall, the present invention provides a user-friendly way of performing yoga, which is advantageous for both teacher and instructor.

EXEMPLARY DIMENSIONS

D1—15 cm; Arms of crosses −5 cm,
M1: Collarbone to Floor;
M2: Foot Length (without toe)
M3: Tip of middle finger to bottom (base) of palm
M4: Root of middle finger to bottom (base) of palm
M5: Shoulder width—to outside of shoulders
M6: Elbow to tip of little finger
M7: Full Length of Foot (optional)
M8: Mat size (length/width—optional)
M9: Height of Person (optional)
M10: Knee to base of foot, when foot flat on floor, shin vertical.

While the present invention has been explained by reference to the examples or preferred embodiments described above, it will be appreciated that those are examples to assist understanding of the present invention and are not meant to be restrictive. Variations or modifications which are obvious or trivial to persons skilled in the art, as well as improvements made thereon, should be considered as equivalents of this invention.

What is claimed:

1. An elongate mat having a surface, the mat comprising: a plurality of indicia located about the surface for guiding placement of one or more parts of a user's body when performing a plurality of yoga postures thereon, wherein the anatomical measurements of parts of the body of the user determine the location of the plurality of indicia on the mat, wherein the plurality of indicia comprise at least a first transverse line made at a predetermined distance from the distal end of the mat and a second transverse line spaced apart from the first transverse line at a distance corresponding to the distance from the collarbone of the standing user to the floor less the distance from the tip of the middle finger of the user to the base of the palm.

2. An elongate mat according to claim 1 wherein the plurality of indicia are located symmetrically about a longitudinal axis.

3. An elongate mat according to claim 1 wherein the mat has a longitudinal axis with a central region, and the plurality of indicia include at least three a third transverse lines, three marks extending substantially parallel to the longitudinal axis, at least one marking on the longitudinal axis, and two markings on each side and spaced apart from the longitudinal axis.

4. An elongate mat according to claim 1 wherein the anatomical measurements of the user specified are selected from the group of measurements comprising: the distance from the collarbone of the user to the floor, the foot length of the user from the base of the heel to the base of the user's toe, the tip of the middle finger of the user to the base of the user's palm, the base of the middle finger of the user to the base of the palm of the user, the width across the shoulders of the user, the distance from the elbow of the user to the tip of the little finger of the user, the full length of the foot of the user and the length of the tibia of the user.

5. An elongate mat according to claim 3 wherein the third transverse line is spaced apart from the second transverse line by a distance corresponding to the distance from the base of the middle finger of the user of the mat to the base of the palm and spaced apart from the second transverse line and further distal to the first transverse line.

6. An elongate mat according to claim 5 wherein the mat has a longitudinal axis with a central region, and a first pair of vertical marks extend from the second transverse line, each of said first pair of marks on either side from the central region and being spaced apart from the central region of the mat at a distance corresponding to the length of the foot of the user from the heel to the toe of user, each of the first pair of marks extending in a parallel direction to the longitudinal axis.

7. An elongate mat according to claim 6 wherein a second pair of vertical marks extending in the direction of the first transverse line at a location spaced apart from the first transverse line a distance corresponding to the distance from the collarbone of the standing user to the floor; said second pair of vertical marks spaced apart on either side of the longitudinal axis, each of said second pair of vertical marks being spaced apart from the longitudinal axis by a distance corresponding to half of the distance between the shoulders of the user.

8. An elongate mat according to claim 7 wherein a first cross indicia is made on the longitudinal axis by measuring a distance from a first pair of origins located on either side of the longitudinal axis on the second transverse line at a distance of half the shoulder width of the user from the longitudinal axis, the distance corresponding to distance from the elbow of the user to the tip of the little finger of the user.

9. An elongate mat according to claim 8 wherein a pair of second cross indicia are located on the mat, by measuring a distance from a second origin located on the longitudinal axis at a distance from the first transverse line corresponding to the distance from the collarbone of the standing user to the floor, and wherein one of each pair of second cross indicia is located on either side of the longitudinal axis at a distance corresponding to the distance from the elbow of the user to the tip of the little finger of the user.

10. An elongate mat according to claim 9 wherein a pair of third cross indicia are located on the mat, each of said pair being located at a distance from the first transverse line which is the sum of the full length of the foot of the user, the length of the tibia of the user and the length of the heel of the user to the base of the big toe; and wherein each of the pair of the third cross indicia are spaced apart from the longitudinal axis by a transverse distance corresponding to the length of the foot of the user from the heel to the toe of user on either side of the longitudinal axis.

11. An elongate mat according to claim 2 wherein the plurality of indicia include at least three transverse lines, three marks extending substantially parallel to the longitudinal axis, at least one marking on the longitudinal axis, and two markings on each side and spaced apart from the longitudinal axis.

* * * * *